US006085922A

United States Patent [19]

Esser

[11] Patent Number: 6,085,922

[45] Date of Patent: Jul. 11, 2000

[54] CONTAINER AND CLOSURE ASSEMBLY WITH TACTILE INDICATION OF CLOSURE POSITION

[75] Inventor: Peter Esser, København S., Denmark

[73] Assignee: NUNC, A/S, Roskilde, Denmark

[21] Appl. No.: 08/808,451

[22] Filed: Feb. 28, 1997

Related U.S. Application Data

[60] Provisional application No. 60/012,618, Mar. 1, 1996.

[30] Foreign Application Priority Data

Feb. 28, 1996 [DK] Denmark ..... 0222/96

[51] Int. Cl.[7] ..... B65D 41/04

[52] U.S. Cl. ..... 215/331; 116/DIG. 17; 116/205; 215/329; 215/320; 215/354; 215/337; 215/44; 215/45; 215/230; 220/296

[58] Field of Search ..... 215/329, 331, 215/332, 336–339, 354, 320, 43–45, 206, 230; 220/296, 293, 290, 288, 301, 300; 116/DIG. 17, 205

[56] References Cited

U.S. PATENT DOCUMENTS

| | | | |
|---|---|---|---|
| 129,235 | 7/1872 | Imlay | 215/331 X |
| 623,380 | 4/1899 | Neiman, Jr. | 220/300 X |
| 1,160,596 | 11/1915 | Hammer | 215/337 |
| 1,621,487 | 3/1927 | Aulbach | 220/296 |
| 1,841,597 | 1/1932 | Hammer | 215/331 X |
| 1,907,254 | 5/1933 | Dodge . | |
| 2,063,157 | 12/1936 | Gray | 215/331 |
| 2,895,640 | 7/1959 | Becker et al. | 116/205 X |
| 3,285,451 | 11/1966 | Golde | 215/320 X |
| 3,459,262 | 8/1969 | Powell | 116/205 X |
| 3,612,324 | 10/1971 | Malick | 215/43 X |
| 3,913,769 | 10/1975 | Scrocco et al. | 215/206 |
| 3,913,783 | 10/1975 | Cooper | 220/300 |
| 4,069,935 | 1/1978 | Hampel . | |
| 4,289,248 | 9/1981 | Lynn . | |
| 4,387,822 | 6/1983 | Lynn . | |
| 4,546,085 | 10/1985 | Johansson et al. . | |
| 4,770,308 | 9/1988 | Lynn . | |
| 4,779,747 | 10/1988 | Morel | 215/206 |
| 4,991,729 | 2/1991 | Hunter | 215/206 |
| 5,038,967 | 8/1991 | Braun . | |
| 5,320,233 | 6/1994 | Welch | 215/331 X |
| 5,449,077 | 9/1995 | Seidler | 215/206 X |
| 5,462,186 | 10/1995 | Ladina et al. . | |
| 5,628,417 | 5/1997 | Van Halteren | 215/44 |
| 5,638,975 | 6/1997 | Harris . | |
| 5,671,321 | 9/1997 | Daykin | 215/354 X |

FOREIGN PATENT DOCUMENTS

| | | |
|---|---|---|
| 304290 | 12/1972 | Austria . |
| 0117722 | 9/1984 | European Pat. Off. . |
| 2597440 | 10/1987 | France . |
| 2346074 | 3/1975 | Germany . |
| 4340229 | 6/1995 | Germany . |
| 2035972 | 6/1980 | United Kingdom . |
| 2288390 | 10/1995 | United Kingdom . |

*Primary Examiner*—Stephen K. Cronin
*Assistant Examiner*—Robin A. Hylton
*Attorney, Agent, or Firm*—Klein & Szekeres, LLP

[57] ABSTRACT

A container and closure assembly, affording a simple, quick, ergonomical, and reliable closing operation, provides an intermediate, partly open position that is reliably indicated. The distance of rotation of the closure relative to the container necessary for closing the closure is short, so that quick and simple closing of the container is provided. The closure is mounted to the container by a projection that is cooperatively received in a track. Either the closure or the container may be provided with the projection, the other being provided with the track. In a preferred embodiment, the track includes a protuberance that hinders the movement of the projection past a predetermined position along the track. When a user turns the closure positioned on the container, the engagement between the protuberance and the projection provides a tactile indication to the user during passage of a specific position of the closure on the container, while also preventing the unintentional movement of the closure past the protuberance.

30 Claims, 5 Drawing Sheets

CONTAINER AND CLOSURE ASSEMBLY WITH TACTILE INDICATION OF CLOSURE POSITION

CROSS-REFERENCE TO RELATED APPLICATION

This application claims the benefit, under 35 U.S.C. Section 119(e), of U.S. Provisional application Ser. No. 60/012,618; filed Mar. 1, 1996.

FIELD OF THE INVENTION

This invention relates to a combination comprising a cell cultivation container defining an opening therein and a closure for closing said opening and for being mounted on the container.

BACKGROUND OF THE INVENTION

Combinations are known from U.S. Pat. Nos. 4,289,248, 4,770,308 and U.S. Pat. No. 4,387,822 which disclose a bottle having screw threads on the neck thereof and a cap having internal no-operating screw threads, the neck and cap furthermore being provided with cooperating protuberances which are forced to ride over each other during the closing and opening rotation of the cap. The protuberances are arranged outside the screw threads, the positions in which they override one another defining intermediary positions of the cap between the fully closed position and the fully open position.

These known combinations require a relatively large rotative travelling distance to achieve closing and opening of he container, and the interthreading of the threads at the start of the closing operation usually is relatively time-consuming and normally requires repeated change of grip and the full attention of the operator owing to the relatively undefined starting points of the threads.

SUMMARY OF THE INVENTION

According to the invention there is provided a combination of the above-mentioned type, wherein the closure is mounted on the container by means of mounting means so as to be rotatable about an axis in relation to the container whereby the closure may be moved along said axis between open and closed positions relative to said container, the mounting means comprising at least one projection arranged on one of the container and closure and track means arranged on the other and cooperating with said at least one projection so as to guide the same along a circumferentially extending track.

Although the track may have a portion extending substantially parallel to said axis, this being advantageous in certain applications, for many applications where it is desirable that the principal or sole action be rotation of the closure, the direction of the track has a circumferential component along the entire length of tie track and an axial component along at least part of said length, and the interaction of said at least one projection with the track means during rotation of the closure provides at least a major part of the axial closing and opening force influencing the closure.

In many applications, it is desirable that an intermediate position of the closure relative to the container in which the closure only partially closes the opening of the container may be achieved and indicated in a reliable and simple manner without the risk of the closure opening fully and perhaps being entirely separated from the container.

Furthermore, it is often desirable that the distance of rotation of the closure relative to the container necessary for closing the closure be as short as possible for allowing quick and simple closing of the container.

These features are, for instance, desirable in containers used for cultivating cells, where it is often required that a venting position of the closure between the fully closed and fully open position thereof allowing interchange of gas between the interior of the container and the surroundings may be reliably and simply achieved, and where it is desirable that the rotation necessary to close, vent and open the container be as short as possible to allow the operation to be performed quickly, ergonomically, in one continuous movement and in a manner allowing manipulation of some other object such as a pipette with the same hand that is used for manipulating the closure or allowing the closure to be mounted on or removed from the container and to be closed and opened with one hand thus freeing the other hand for manipulating, for instance, a pipette. In relation to containers for pressurized or carbonated liquids it is also often desirable to have an intermediary, partly open position for pressure relief prior to opening the container.

These features are also desirable in thermos jugs or bottles where a partially open pouring position of a, for instance, cork-like closure is desired achieved and indicated reliably and simply without the risk that the closure be separated from the container during pouring while limiting the rotative closing and opening travel of the closure to a minimum.

An object of the invention is to provide a combination of a closure and a container which affords a simple, quick, ergonomical and reliable closing and opening operation and wherewith an intermediary, partly open position may be achieved and indicated in a reliable manner.

This object is obtained according to the invention by the mounting means including at least one hindering means for hindering the movement of the projection past a predetermined position along the track.

So as to maintain the closure in an intermediate, partially open position against the influence of rotative forces in the opening or the closing direction, said at least one hindering means may define a projection retention region of the track in which the projection is retained by said hindering means. Hereby a partially open position may reliably be established, indicated and maintained, requiring application of an appreciable rotative force to locate the closure in or dislodge same from said partially open position, the said rotative force affording a tactile indication to the user that the projection either is entering the retention region or is leaving same.

The hindering means may comprise any suitable mutually cooperating operating elements of the closure and the container arranged at any suitable locations on same for cooperation during rotation of the closure relative to the container to hinder the movement of the projection along the track. Such elements may correspond to the projections and protuberances disclosed in the mentioned U.S.-Patents but may also for instance comprise cooperating cam-like surface portions on said container or closure. However, particularly simple and reliable embodiments of the hindering means may be achieved according to the invention when the track means include said at least one hindering means.

Preferably, the track means include two hindering means located at a distance from each other along the track sufficient for the projection to be retained in the projection retention region thus defined by said two hindering means.

During the closing operation of the closure relative to the container the resistance against rotation may vary, for instance because of the engagement and any subsequent tightening of resilient sealing means on said container or closure relative to each other. So as to compensate for such variations in resistance against rotation and to obtain other advantages, the axial component of the track may have at least two different axial inclinations along the length thereof. Hereby, the axial movement of the closure relative to the container resulting from a given amount of rotation may be varied according to the requirements at the different stages of the closing and opening movement.

Although the axial inclination of the axial component may vary continuously along some parts of the length of the track and be constant along other parts of the track, the axial component preferably has a first axial inclination along the first stretch of the track in the closure closing direction of movement of the projection along said track, a second axial inclination along the subsequent second stretch and a third axial inclination along the subsequent third and final stretch, the first axial inclination being larger than the second and the third axial inclination being substantially equal to zero.

This is advantageous in case cooperating, resilient sealing means of the container and the closure are to be brought into resiliently deformed, sealing engagement with one another to hermetically seal the container. The first stretch of the track is utilized to bring the closure from its fully open position into the position where the sealing means start engaging one another. Along this first stretch the resistance against rotation is mainly due to the axial movement of the closure to be generated and therefore the inclination of the track may be steeper to reduce the rotation travel as much as possible. The second stretch of the track is utilized to sealingly engage the sealing means with one another, and therefore the resistance against rotation is substantially larger requiring a less steep inclination of the track so as to not increase the rotative force required too much Relative to the first stretch. The final stretch is utilized to move the projection away from the inclined second stretch so as to ensure that no accidental opening of the closure may occur. Such a variation in the axial inclination of the axial component is of course advantageous irrespective of whether hindering means are provided or not.

Although projection retention regions may be disposed at any point along the track, in cases where for instance a venting or pouring position is to be established it is preferable that a projection retention region be located adjacent the starting point of the first stretch in said closing direction so that a tactile indication is given when a projection leaves a corresponding retention region in the opening direction whereby a clear indication is provided that the closure has been moved to its loose position.

In its loose position, the closure may be separated from the container by moving the closure solely in the axial direction of the container, i.e. without turning the closure relative to the container.

In other positions of the closure on the container, the closure can not be separated from the container without turning the closure relative to the container.

So as to avoid a common problem in connection with closures operating on a rotative principle where the closure may be screwed on too tightly causing problems in connection with opening and/or causing damage to the closure mechanism the mounting means according to the invention may comprise stopping means for effectively stopping the closing movement of the projection at the end of the track in the closing direction. Hereby the closing operation is effectively limited with a clear indication of this limitation, and the closure may not be closed tighter than the design provides for.

So as to further enhance the ease and simplicity of fitting the closure to the container and closing the former in relation to the latter, the mounting means may further be provided with projection positioning means for guiding the projection into a position adjacent the starting point of the track when the closure is moved in the axial closing direction thereof from its loose position. Hereby it is obtained that the closure will be guided into a position ready for engaging the container so that the user does not have to pay attention to and waste time on this phase of the closing operation.

A particularly simple and reliable closure mechanism is obtained according to the invention by the track means comprising a guiding channel for receiving the projection, the walls and/or bottom of the channel defining the track, and advantageously the stopping means may comprise the end of the channel in the closing direction.

The projection and the track means may be arranged on the corresponding closure and container in various manners as long as they can cooperate as intended. For instance, they may be arranged on support elements such as arms attached to each or one of the two means. However, a particularly simple design is obtained by the container comprising a first surface portion and the closure comprising a corresponding second surface portion, both surface portions defining a surface of revolution with respect to said axis, the said at least one projection being arranged on one of said surface portions and the track means on the other surface portion. Said surface portions may be circular cylindrical or frustoconical or be any other suitable surface of revolution allowing the closure to move along said axis.

Although the channel may be formed in many ways on the corresponding surface portion, for instance by means of protruding lateral walls or rows of protuberances defining the channel, a particularly simple, reliable and cost-effective design is obtained according to the invention by the channel being formed by a recessed groove in the corresponding surface portion.

The hindering means may comprise a variety of elements associated with or forming part of the channel, for instance a variation of the axial inclination of the axial component so as to provide a larger resistance against rotation of the closure at the point along the track where the change in size of the axial component takes place or for establishing a stretch of the track with a small or non-existent axial component, said stretch defining a projection retention region, or even a stretch having an axial component directed opposite the direction of the axial component along the rest of the track. The distance between the walls of the channel may vary to provide constricted regions hindering the passage of the projection, or the depth of the channel may vary with the same purpose.

However, a particularly simple and reliable design providing a well defined tactile indication of the action of the hindering means is obtained according to the invention by the at least one hindering means comprising one or more protubarances in the walls and/or bottom of the channel for reducing the cross sectional area of the channel enough to force a projection to be appreciably deformed and/or deflected when moving along the channel past said protuberances.

In case a well defined venting or pouring position of the closure is to be provided, two spaced protuberances on the bottom of the channel may define a projection retention zone therebetween.

Advantageously, there may be provided three projections and three corresponding tracks, the circumferential angle between the projections being 120° and the circumferential angle between corresponding starting points of the tracks also being 120°.

Preferably, the angular distance between two protuberances defining the retention region of the cap in its venting position is between 10° and 20° C., preferably approximately 15°.

Further, it is preferred that the angular movement of the closure required to move the closure from a central position of its venting position to its closed position, or vice versa, is between 45° and 180°, preferably approximately 45° or approximately 60° or approximately 135° or approximately 180°, and more preferred approximately 60°.

However, there may also advantageously be provided four projections and four corresponding tracks, the circumferential angle between the projections being 90° and the circumferential angle between corresponding starting points of the tracks also being 90°.

Particularly simple and reliable projection positioning means comprise a funnel-shaped channel in the corresponding surface portion, the walls of the funnel-shaped channels tapering inwards in the axial closing direction of the projection so as to lead the projection to a location adjacent the starting point of the guiding channel when the closure is moved in its axial closing direction from its loose position. Hereby walls of the funnel-shaped channel guide the projection towards the narrow portion of the funnel-shaped channel ending at a point adjacent the starting point of the guiding channel.

In many applications, for instance in the case of arrays of cell cultivation flasks where it is desirable to quickly visually determine whether a closure is closed or in a venting position, or in the case of a thermos jug where it is desirable to quickly visually determine whether the jug is ready for pouring, it is advantageous that the exterior of the closure be provided with visible means to indicate when the projection is located in a retention region of the track and when the projection is located in the innermost position along said track.

In certain applications it is advantageous that the first surface portion constitute an interior surface of the container and the second surface portion constitute an exterior surface of the closure, and in such case it is advantageous that the container comprise a passage leading to the interior of the container, said passage defining said opening and the first surface portion, the closure comprising a plug body for insertion in and closure of said opening, said plug body defining the second surface portion.

In certain applications it is advantageous that the first surface constitutes an exterior surface of the container and the second surface constitutes an interior surface of the closure, and in such case it is advantageous that the container comprises a neck portion defining the opening therein and the first surface portion, the closure comprising an end portion for closing said opening and a skirt portion depending from said end portion and defining the second surface portion.

In order to create the completely hermetical seal necessary in cell cultivation containers, it is typically necessary for the closure to be provided with a flexible element to be pushed against or, typically, into the opening of the container, such as in the form of a plug body for insertion into and closure of the opening as described above. To simplify production thereof, the entire closure will typically be made from a flexible material such as a flexible plastic material. However, as a result of the axial movement of the closure, caused by a rotary movement imparted thereto, designed to force the seal into the container opening, the seal typically having a slightly larger diameter than the opening, the closure may be prone to tilt and disengage part of the mounting means intended to ensure the axial movement of the closure upon rotation, so that the axis of the closure no longer coincides with the axis of the opening of the container which may cause the seal to be incomplete and hence jeopardize the purity of the culture in the container. Another aspect of the invention therefore relates to measures intended to prevent the tilting of the closure and hence to ensure that the seal of the container is hermetical.

Consequently, the invention also relates to a combination comprising a cell cultivation container defining an opening therein and a closure for closing said opening and for being mounted on the container by mounting means so as to be rotatable about an axis in relation to the container whereby the closure may be moved along said axis between open and closed positions relative to said container, the combination comprising cooperating supporting means on at least one of the container and closure for positioning the closure in relation to the container so that the container opening and the closure are brought into a substantially coaxial position.

The cooperating supporting means may be located on the closure or on the container or on both the closure and the container and may typically comprise surface parts raised above the surrounding surface of the container and/or closure.

One part of the cooperating supporting means may simple be the surface of the inside of the closure or the surface of outside of the container, such as the outside of the neck portion, or it may be parts of these surfaces such as surface parts defining positioning means for the closure/container connection, e.g. surfaces defining the funnel-shaped channel described above.

Another part of the cooperating supporting means may comprise other surface parts raised above the surrounding surface of the container or closure, such as a series of projections shaped like e.g. a hemisphere or spherical segment, a spheroid segment, a cube or box, pyramid, cone or truncated cone. The cooperating supporting means may preferably be one or more ridges located on the surface of the inside of the closure or the surface of outside of the container, such as the outside of the neck portion, and such ridges are preferably extending substantially along a circumference on the closure or the container.

The term "extending substantially along a circumference" is intended to indicate that the ridge in question may form an acute angle, such as up to 30°, with a plane perpendicular to the axis of the closure or of the container opening, which may be appropriate if geometric or manufacturing considerations warrant it.

Furthermore, the ridge or ridges in question may form a ring circumscribing the closure or container neck portion, or the ridge(s) may merely form sections of such a ring or such rings. Such a ridge or ridges may have a substantially semicircular or circle segment, ellipse segment, square or rectangular cross section or, preferably, a substantially trapezoidal cross section.

The apex points or surface of the projections or ridges are preferably positioned on a common cylinder surface, the axis of which is coaxial with the closure or container on which they are located.

BRIEF DESCRIPTION OF THE DRAWINGS

The invention will now be explained more in detail in connection with the embodiments described by way of example only with reference to the accompanying drawings, where FIG. 8 is a partial sectional view along line C—C in FIG. 3, FIGS. 9 and 10 are top views of the cap shown in FIG. 3 in the venting and closed position, respectively.

DETAILED DESCRIPTION OF THE INVENTION

Figure 1:
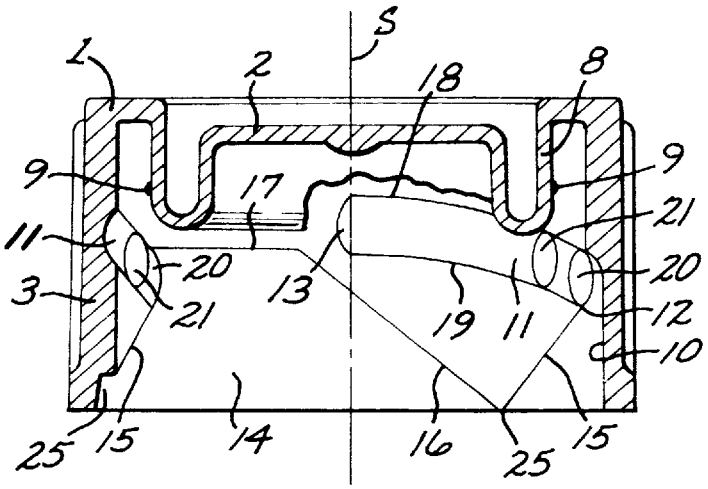
FIG. 1 is a diagrammatic cross-sectional view of a preferred embodiment of a closure according to the invention in the form of a cap for a cell cultivation container.
Figure 2:
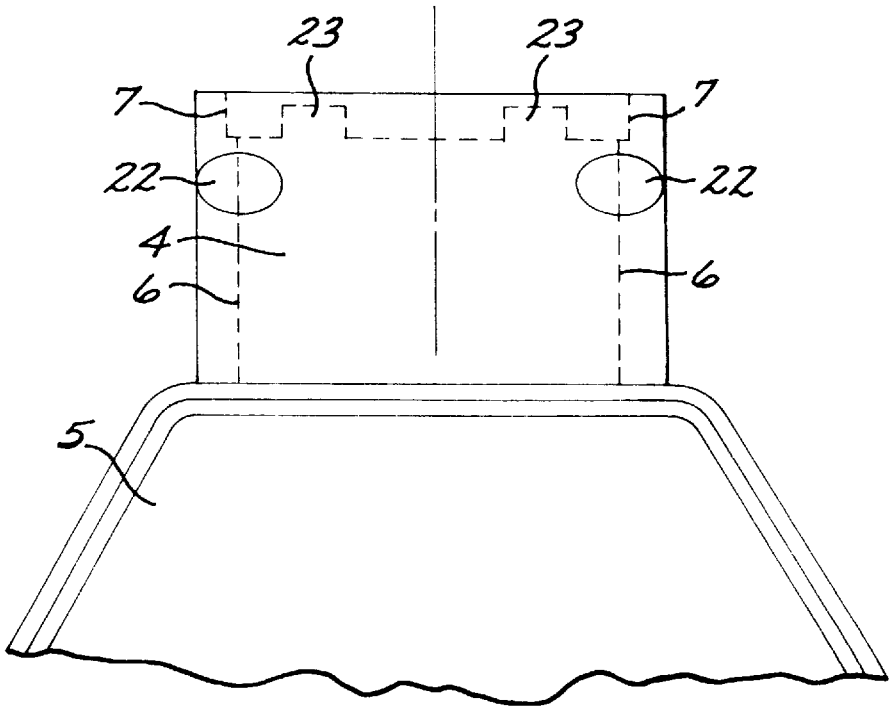
FIG. 2 is a diagrammatic elevational view of a preferred embodiment of a container according to the invention in the form of a neck portion of a cell cultivation container and corresponding to the closure shown in FIG. 1.

Referring now to FIGS. 1 and 2, a circular cylindrical cap 1 has an end portion 2 with a circular cylindrical skirt 3 depending therefrom. The skirt 3 has an interior diameter corresponding to the exterior diameter of a circular cylindrical neck portion 4 of a cell cultivation container 5 so that the cap 1 may be fitted concentrically over the neck portion 4 so as to close a passage therethrough defined by a circular cylindrical surface portion 6 and a circular cylindrical surface portion 7 having a slightly larger diameter than surface portion 6, both surface portions being indicated by dotted lines in FIG. 2.

The end portion 2 of the cap 1 is provided with an inner skirt portion 8 provided with a circumferentially extending bead 9. The inner surface 10 of the skirt 3 (also see FIG. 4) is provided with three recessed guiding channels 11 each having an inlet or starting point 12 and an end 13, the circumferential angle between neighbouring starting points 12 being 120° or approximately 120°. The inner surface 10 of the skirt 3 is furthermore provided with three funnel-like, recessed positioning channels 14 defined by walls 15 and 16 tapering towards each other, the wall 16 terminating in one end of a wall 17 terminating at the other end in the starting point of one wall 18 of a guiding channel 11. The wall 15 terminates in the starting point of the other wall 19 of the guiding channel 11.

Figure 4:
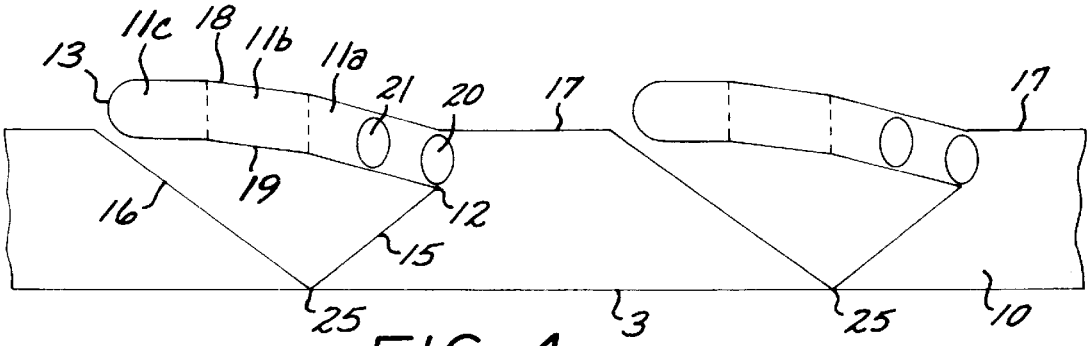
FIG. 4 is a developed partial view of the interior surface of the skirt of the cap shown In FIG. 1 having a preferred embodiment of the track means according to the invention arranged thereon.

Referring now also to FIG. 4, the guiding channel 11 comprises three stretches 11*a*–11*c*, the stretch 11*a* having a larger axial inclination than stretch 11*b*, and stretch 11*c* extending substantially at right angles to the axis of the cap 1, i.e. having substantially no axial inclination. The bottom of the channel stretch 11*a* is provided with two spaced, rounded protuberances 20 and 21 having a height substantially smaller than the depth of the channel 11.

The outer surface of the neck portion 4 is provided with three rounded projections 22 arranged at a circumferential angle of 120° from one another and having an outer contour for fitting into and being guided along the recessed guiding channels 11.

The cylindrical surface portion 7 is provided with six equidistantly spaced, axially extending projections 23, the inwardly facing surfaces of which define a circular cylindrical surface having substantially the same diameter as the surface portion 6.

The design and function of tie inner skirt 8, the annular bead 9, the surface portions 6 and 7 and the axial projections 23 are analogous to the corresponding elements designated by the numerals 12, 15, 4, 5 and 6, respectively, disclosed in U.S. Pat. No. 4,546,085 to Arne Johansson et al. The objective of the features just mentioned is substantially the same as disclosed in said patent as regards said corresponding elements.

Figure 3:
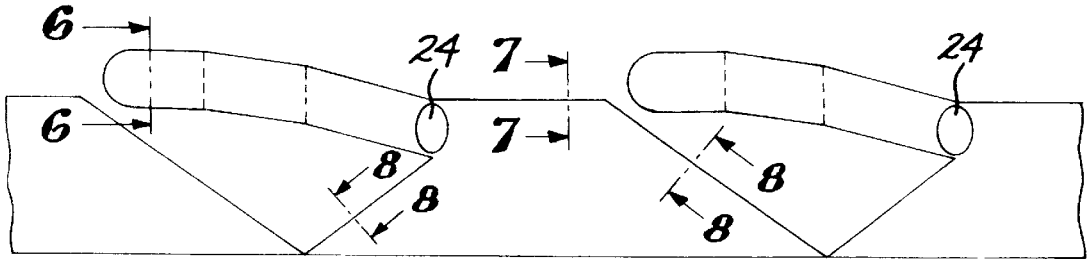
FIG. 3 is a developed partial view of the interior surface of the skirt of a cap similar to the one shown in FIG. 1 having a first alternative embodiment of the track means according to the invention arranged thereon.
Figure 5:
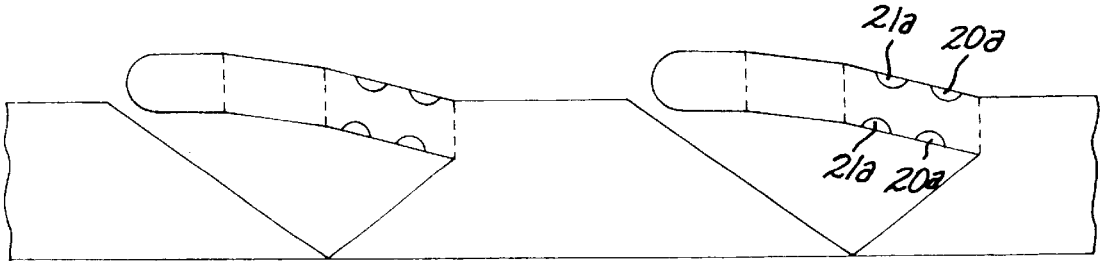
FIG. 5 is a developed partial view of the interior surface of the skirt of a cap similar to the one shown in FIG. 1 having a variant of the preferred embodiment of the track means according to the invention arranged thereon.

Referring now to FIGS. 3–5, the sole difference between the three configurations of the track means shown in FIGS. 3–5 is that in FIG. 3 only one protuberance 24 is arranged in the bottom of the stretch 11*a* at the inlet thereof while in FIG. 5 the two protuberances 20 and 21 on the bottom of stretch 11*a* of FIG. 4 have each been replaced by two rounded protuberances 20*a* and 21*a*, respectively, on the side walls 18 and 19, respectively.

Figure 6:
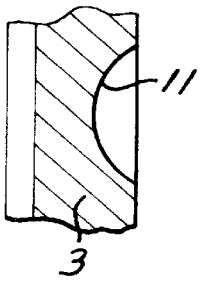
FIG. 6 is a partial sectional view along line A—A in FIG. 3.
Figure 7:
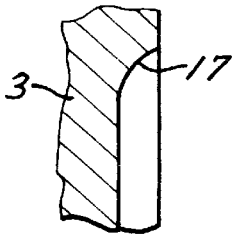
FIG. 7 is a partial sectional view along line B—B in FIG. 3.
Figure 8:
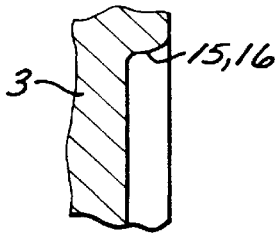
FIG. 8 is a partial sectional view along line C—C in FIG. 3.

In FIGS. 6–8 the cross sectional profile of the guiding channel 11 taken along line A—A, the cross sectional profile of the wall 17 of the positioning channel 14 taken along line B—B, and the cross sectional profile of the walls 15 and 16 taken along line C—C, have respectively been illustrated.

The profile of the channel 11 is substantially semi-circular and corresponds to the substantially semi-spherical outer surface of the central portion of the projection 22, the spherical diameter preferable being smaller than the circular diameter for affording certain tolerances in the cooperation between the projection 22 and the walls and bottom of the channel 11.

The profile of the wall 17 is the same as the profile of the wall of the channel 11 so that there will be no transition between said walls to impede the passage of the projection at the inlet 12 of the channel 11.

The profile of the walls 15 and 16 has a shape allowing a sharp or pointed configuration of the intersection 25 of the walls 15 and 16 at the edge of the skirt 3 (see FIG. 1) so that the projection 22 will be guided either along the wall 15 or the wall 16 as described below if it should encounter the intersection when the cap 1 is axially slipped onto the neck 4.

In operation, the cap 1 of the embodiment shown in FIGS. 1–2, 4 and 6–8 is gripped, for instance between the little finger and the palm of one hand, said hand perhaps also holding a pipette with which material has been introduced into the container 5, and is fitted axially onto the neck portion 4. The projections 22 will be guided to engage the walls 17 by means of either the wall 15 or the wall 16 so that the projections automatically are guided into a position adjacent the inlets of the channels 11 without requiring any attention from the user. Rotation of the cap 1 will cause the projections 22 to enter the channels 11. Continued rotation of the cap 1 will cause the projections to ride over the protuberances 20 causing a resilient deflection and/or deformation of the projections 22 and the protuberances 20 giving rise to a resistance against rotation that can be felt by the user as an indication that the projections are passing into the projection retention regions between the protuberances 20 and 21.

Thus, the hindering means, in this example formed by cooperating protuberances 20, 21 and projections 22, perform several functions. They prevent the cap 1 from unintentionally moving from one position to another position on the container 5 either in the closing direction of the cap 1 or in the opening direction of the cap 1. Further, they provide indication that can be felt by the user when a projection passes a protuberance thereby clearly signalling to the user that the cap 1 has changed position on the container 5.

For example, the cooperation of the projection 22 and the protuberance 20 serves to ensure that tactile indication is given when the projection 22 passes the protuberance 20 either in the opening direction or in the closing direction whereby a clear indication is provided when the closure is moved from its venting position to its loose position or vice versa. The cooperation of the projection 22 and the protuberance 20 also serves to ensure that the cap 1 can not unintentionally move from its venting position to its loose position or vice versa.

Further rotation of the cap 1 will cause the projection 22 to ride over the protuberance 21 and continue along stretch 11*a* of the channel 11. The movement along said stretch 11*a* causes the cap 1 to move axially relative to the neck portion 4 while the annular bead 9 of the inner skirt 8 rides along the projections 23 of the surface portion 7. The transition point between stretch 11*a* and stretch 11*b* substantially corresponds to initial engagement of the annular bead 9 with the surface portion 6 whereby the resistance against rotation increases. The inclination of the stretch 11*b* is correspondingly smaller than the inclination of stretch 11*a*, thereby to a certain extent compensating for the greater resistance against rotation. When the projection 22 has reached the transition point between stretch 11*b* and stretch la the annular bead 9 fully sealingly engages the surface portion 6 and no further axial movement of the cap 1 is required to seal the interior of the container 5 relative to the surroundings.

Movement of the projection 22 along the final stretch 11*c* will not cause any axial movement of the cap 1 as the inclination of the stretch 11*c* is substantially zero. When the projection 22 reaches the end 13 of the channel 11 it will be effectively stopped, thereby clearly indicating to the user that no further rotation of the cap 1 is possible. This end position of the projection 22 affords security against accidental opening of the cap 1 as the projection has to move along the entire stretch 11*c* before entering stretch 11*b* where accidental opening may take place much more easily.

In the venting position of the cap 1, the annular bead 9 only engages the inner surfaces of the axial projections 23 whereby venting communication between the inner volume of the container and its surroundings is provided along the regions between the projections 23, said regions being spaced from the annular bead 9 and thus forming venting passages.

Typically, the cap 1 is positioned in its venting position after a cell culture has been introduced into the corresponding container at room temperature. With the cap 1 in its venting position, the container can be positioned in an incubator at 37° C. without creation of a pressure increase in the container that otherwise would be caused by the increased temperature.

The cap 1 is positioned in its venting position by rotation until the projection 22 rides over the protuberance 20 and lodges between it and the protuberance 21. It will require a significant force to dislodge the projection 22 from this projection retention region and therefore the venting position of the cap 1 is stable.

Correspondingly, when it is desired to communicate the interior of the container 5 with the surroundings without positioning the cap 1 in its loose position and, e.g. accidentally, removing the cap 1 from the container thereby allowing contaminants to easily enter the container, the cap 1 is rotated until the projection 22 rides over the protuberance 21 and lodges between same and the protuberance 20.

Owing to the short length of the channels 11, the rotative travel necessary to close, vent and open the cap 1 is small thereby allowing quick and ergonomical operation by a user. The precise and automatic positioning of the projections 22 at the inlets of the channels 11 and the short rotative travel enables the user to easily hold a pipette for inserting material in the container 5 with the same hand that is used to manipulate the cap 1. The cap 1 and the container 5 may also easily and ergonomically be manipulated with one hand thus freeing the other hand for manipulating the pipette. When dealing with a large number of containers at a time, these factors become particularly important.

Although any suitable materials such as plastic, glass, steel, aluminium, etc. may be chosen for the cap and the container, it has been found that it is advantageous that the softness of the materials for each of these elements should be appreciably different so that friction against rotation may be reduced. Furthermore, it is advantageous that the material of at least one of these elements be resiliently deformable so to facilitate the cooperation of the projections with the channels and with the protuberances. A suitable choice of materials has been found to be high-density polyethylene for the cap 1 and polystyrene for the container neck 4.

The length and the inclination of the channels 11, the number of different stretches with different inclinations and the number of protuberances as well as the location thereof may be varied according to the requirements of the different applications.

Thus, referring now to FIG. 3, a single protuberance 24 may be arranged adjacent the inlet 12 of the channel 11. The cooperation of the projection 22 and the protuberance 24 corresponds to the cooperation of the projection 22 and the protuberance 20 as described above with reference to FIG. 4. The cooperation serves to ensure that tactile indication is given when the projection 22 passes the protuberance 24 either in the opening direction or in the closing direction whereby a clear indication is provided when the closure is moved from its closed position to its loose position or vice versa. This embodiment of the invention is preferred when the end portion 2 of the cap I is provided with one or more apertures therethrough covered by a filter element so that the interior of the container is in continuously filtered gas communication with the surroundings when the cap 1 is in its closed position.

Figure 9:
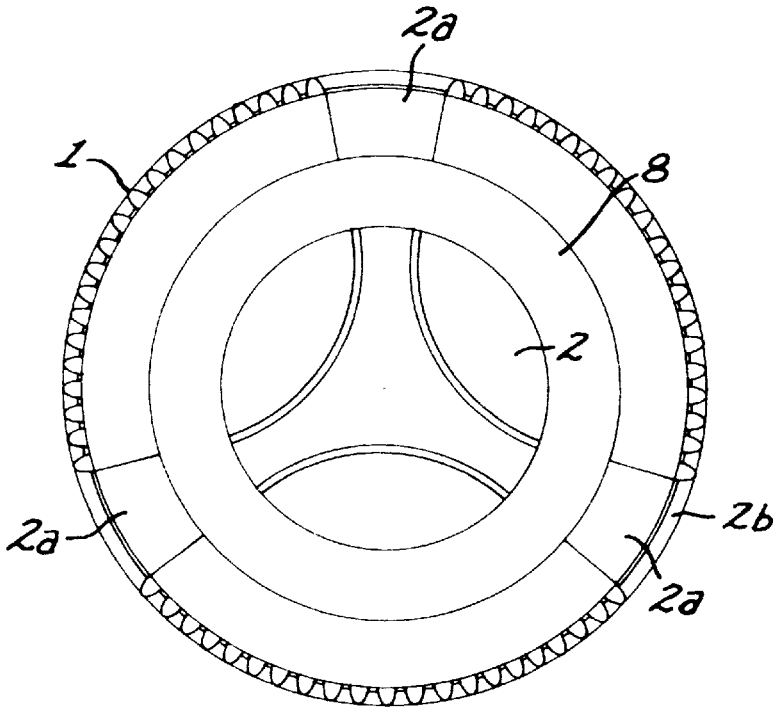
Figure 10:
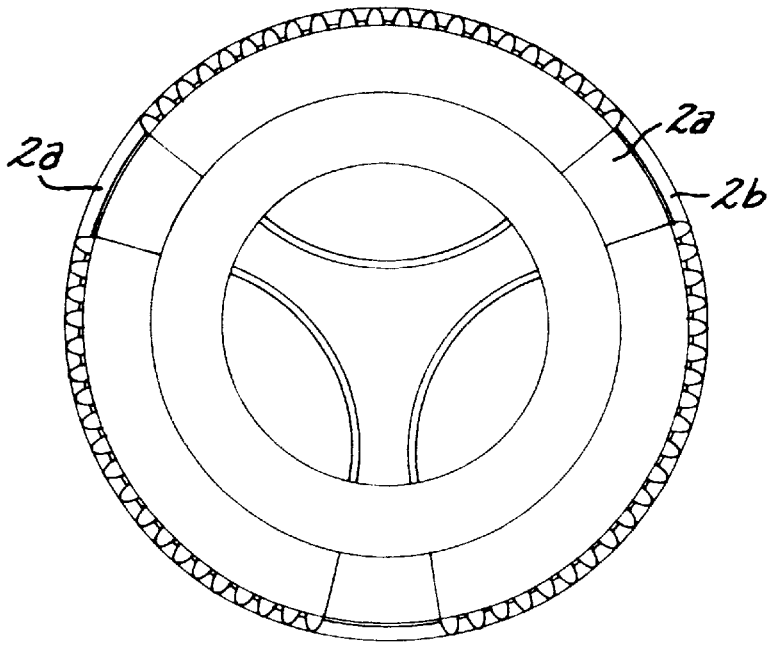

Referring now to FIGS. 9 and 10 showing a top view of the cap 1 of FIG. 1 in two different positions corresponding respectively to the fully closed position of the cap 1 and to the vent position of same. Marks 2*a* are arranged on the surface of the end portion 2, and axially extending marks 2*b* are arranged on the skirt 3. The marks 2*a* form a visible image approximating an inverted Y when viewed at a distance and corresponding to the vent position of the cap 1. The rotative travel, in this example approximately 60°, necessary to move the projection 22 from the vent position between the protuberances 20 and 21 and to the fully closed position abutting the end 13 of the channel 11 causes the image to approximate a right-side-up Y. The marks 2*b* have a similar function when viewing the cap 1 at a substantial angle to the axis.

Hereby the closed containers of for instance an array of horizontal containers arranged in a vertical rack may at a glance be differentiated from any venting containers in the array. This is time-saving, particularly when dealing with a large array of identical containers. In case four projections 22 and four channels 11 are provided, four marks spaced 90° may form a cross in the vent position and an X in the closed position. Naturally, other markings utilizing the angle of rotation may be incorporated to visibly indicate the position of the cap, particularly as the angle of rotation may be varied within wide limits according to the required qualities of the combination.

Figure 11:
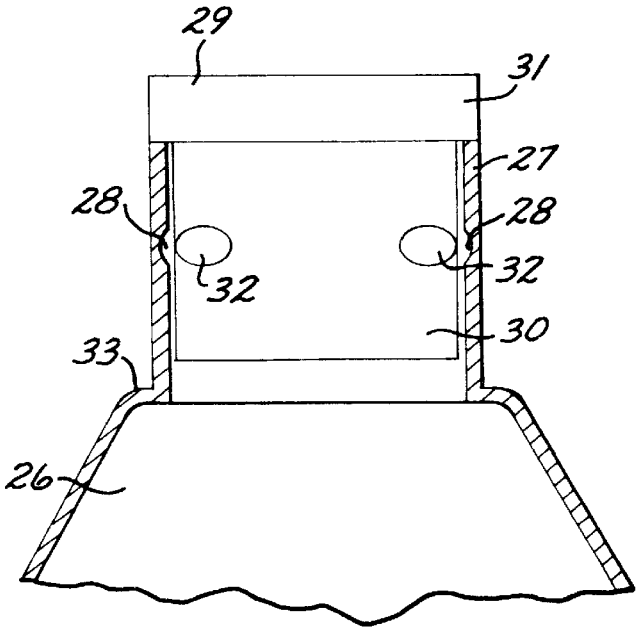
FIG. 11 is a diagrammatic elevational view of a second alternative embodiment of a combination of a closure and a container according to the invention.

Referring now to FIG. 11, a container 26 is provided with a neck portion 27 having three circumferentially equidistant, recessed guiding channels 28 very similar to the channels 11 of FIG. 1 on the inner surface thereof. A cork-like closure 29 having a body 30 and an end portion 31 is provided with three circumferentially equidistant projections 32 very similar to the projections 22 of FIG. 1 on the outer surface of the body 30. The inner surface of the neck portion 27 is provided with projection positioning channels (not shown) very similar to the channels 24 of FIG. 1 for guiding the projections to corresponding points adjacent the inlets of the guiding channels 28.

The channels 28 are provided with protuberances (not shown) very similar in configuration and as regards location to the protuberances 20 and 21 of FIG. 4. The operation of the embodiment of FIG. 11 is very similar to the operation of the embodiment of FIGS. 1 and 2, the plug-like body 30 being inserted axially in the neck portion 27 instead of the skirt 3 being slipped over the neck portion 4. The projections 32 cooperate with the projection positioning channels, the channels 28 and the protuberances in the channels substantially as described for the embodiment of FIGS. 1 and 2. The sealing means between the closure 29 and the neck portion 27 may be of many different types and configurations.

It will be obvious to those skilled in the art that many variations and modifications are conceivable within the scope of the invention as defined in the appended claims.

The cooperating surface portions of the closure and the container may be frusto-conical or have the shape of any other suitable surface of revolution suitable for other applications. The cooperating sealing means of the closure and the container may be arranged in many manners. An annular, resiliently compressible seal may for instance be arranged at the end of the body 30 of FIG. 11 opposite the end portion 31 for cooperation with an annular seal or flange arranged on the inner surface of the neck portion 27 near the shoulder 33 between the neck portion 27 and the body of the container 26.

The channels for guiding the projections may comprise U-profile rails arranged on support members depending from the end portion of a cap similar to cap 1 in FIG. 1, the support members, for instance arms projecting from the end portion 2, replacing the skirt 3.

The embodiments shown in FIGS. 1 and 11 may be suitably modified so as to be used for a thermos flask having pouring passage means provided in the closure and/or the container, said pouring passage means being in a pouring position or configuration when the projections are in a projection retention region of the guiding channels defined by hindering means such as for instance protuberances corresponding to the ones described above.

The channels, projections and protuberances may have various sectional profiles as long as they are suited for the functions according to the invention. The projections and the protuberances may be arranged with a spaced relationship to the guiding channels and may be replaced by any other suitable hindering means such as for instance cam-like cooporarating surface portions on the closure and the container.

Figure 12:
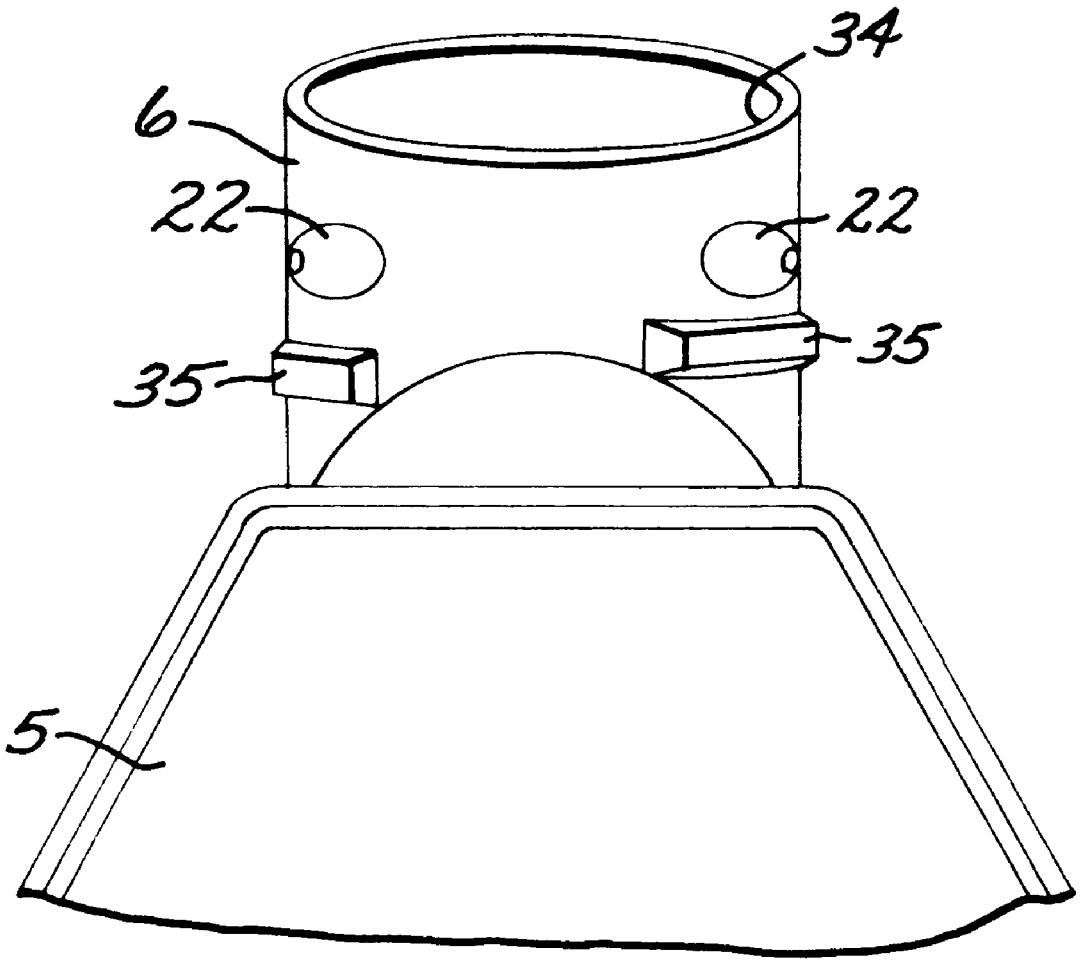
FIG. 12 is an elevational view of a cell cultivation container according to the invention in the form of a neck portion of a-container similar to that shown, in FIG. 2 but where the neck portion further comprises cooperating supporting means.

Referring now to FIG. 12 as well as FIG. 1 and FIG. 2, a container 5 has a neck portion 6 designed to be covered by a cap identical to that shown in FIG. 1, i.e. with an inner skirt portion 8 provided with a circumferentially extending bead 9, the purpose of which is to be pushed into the neck portion 6 and to create a hermetical seal against the inside surface 34 of the upper part of the neck portion 6. As with the container shown in FIG. 2, the projections 22 are intended to interact with the guiding channels of the chip in FIG. 1 in the manner described above, and in order to prevent any tilt of the cap bringing the cap and neck portion cut of a coaxial position, the neck portion 6 is provided with supporting means in the form of ridges 35 having a substantially trapezoidal cross section. As it will be evident from FIG. 12, the axis of the neck portion 6 is not parallel to the plane of the paper, which in turn means that the ridges in fact form part of rings defining planes that are not perpendicular to the neck axis.

The outer surface of the ridges 35 form part of a cylinder surface coaxial with the neck portion 6 and cooperate with the walls 15 and 16 of the cap during the rotary movement of the cap in that the walls 15 and 16 slide across the outer ridge surfaces. During said rotation movement, the neck portion is closed by the cap by pushing the inner skirt 8 and its associated bead 9 into the neck portion, and as a result of the cooperation between the outer surfaces of the ridges 35 and the walls 15 and 16, the cap is prevented from tilting, thereby ensuring that a complete, hermetical seal is established.

What is claimed is:

1. A closure for closing an opening in a container, the container having a projection adjacent the opening, the closure comprising:

a circumferentially extending guiding channel defined by opposed walls that are located and configured to receive between them the projection on the container when the closure engages the container, the guiding channel having an end in the closing direction and a starting point, between which the guiding channel includes (a) a first axial inclination along a first stretch of the guiding channel in a closure closing direction of movement of the projection along said guiding channel, (b) a second axial inclination along a subsequent second stretch of the guiding channel, and (c) a third axial inclination along a subsequent third stretch of the guiding channel; and first hindering means in the guiding channel that cooperate with the projection, during rotation of the closure relative to the container, for hindering movement along the guiding channel of the projection past a predetermined first position along the guiding channel and for providing a tactile indication during rotation of the closure on the container when the projection passes the first position;

so that the closure is (a) positionable on the container in an open position, from which position the closure is removable from the container without rotation of the closure, and (b) rotatable about an axis in relation to the container, whereby the closure is movable repeatedly back and forth between the open position and a closed position, with provision of a tactile indication when the closure is moved between the open position and the closed position.

2. The closure defined in claim 1, further comprising:

second hindering means in the guiding channel that cooperate with the projection during rotation of the closure relative to the container, for hindering movement along the guiding channel of the projection past a predetermined second position along the guiding channel, for providing a tactile indication during rotation of the closure on the container when the projection passes the second position, and for defining a projection retention region of the guiding channel between the first and the second positions in which the projection is retained by the first and second hindering means in a venting position of the closure in which a venting passage is opened between the closure and the container;

so that the closure is (a) positionable on the container in an open position, from which position the closure is removable from the container without rotation of the closure, and (b) rotatable about an axis in relation to the container, whereby the closure is movable repeatedly back and forth between the open position, the venting position in which the projection is retained by the first and second hindering means, and a closed position, with provision of a tactile indication when the closure is moved between its venting position, its open position and its closed position.

3. The closure defined in claim 1, wherein the first axial inclination is larger than the second axial inclination and the third axial inclination is substantially equal to zero.

4. The closure defined in claim 1, wherein the first hindering means is located so that a tactile indication is given when the closure has reached its open position after rotation from its closed position.

5. The closure defined in claim 1, wherein the guiding channel include the first and second hindering means located at a distance from each other along the guiding channel so that the projection may be retained in the projection retention region thus defined by the first and second hindering means.

6. The closure defined in claim 1, further comprising stopping means for effectively stopping the closing movement of the projection at the end of the guiding channel in the closing direction.

7. The closure defined in claim 1, further comprising projection positioning means for guiding the projection into a position adjacent the starting point of the guiding channel when the closure is moved in the axial closing direction thereof from the open position.

8. The closure defined in claim 7, wherein the projection positioning means comprises a funnel-shaped channel in the corresponding surface portion, the funnel-shaped channel having walls that taper inwardly in the axial closing direction of the projection so as to lead the projection to a point adjacent the starting point of the guiding channel when the closure is moved in its axial closing direction from the open position.

9. The closure defined in claim 8, wherein the funnel-shaped channel is formed between two triangular-shaped walls providing a sharp tip of the walls at the opening of the funnel shaped-channel.

10. The closure defined in claim 1, further comprising indicating means positioned on an outer surface of the closure, for visually indicating when the projection is located in the retention region of the guiding channel and when the closure is in the closed position.

11. The closure defined in claim 1, wherein the closure comprises three guiding channels for cooperation with three corresponding projections of the container, and the circumferential angle between corresponding starting points of the guiding channels is about 120°.

12. The closure defined in claim 11, wherein an angle is defined between a center of the venting position of the closure and its closed position of approximately 60°.

13. The closure defined in claim 1, wherein the closure comprises four guiding channels for cooperation with four corresponding projections of the container, and a circumferential angle between corresponding starting point of the guiding channels is of about 90°.

14. The closure defined in claim 13, wherein an angle is defined between a center of the venting position of the closure and its closed position of approximately 45°.

15. A container and closure assembly, comprising:

a container having an opening defined therein;

a closure configured for closing the opening; and closure mounting means comprising:

a projection on one of the container and the closure;

a circumferentially extending guiding channel defined by opposed walls that are configured to receive the projection between them, the channel being provided in the one of the closure and the container that does not have the projection, the guiding channel including a starting point and an end, between which the guiding channel includes (a) a first stretch having a first axial inclination in a closure-closing direction of movement of the projection along the guiding channel, (b) a subsequent second stretch having a second axial inclination, and (c) a subsequent third stretch having a third axial inclination;

first hindering means comprising mutually cooperating elements of the closure and the container that cooperate during rotation of the closure relative to the container, for hindering movement along the guiding channel of the projection past a predetermined first position along the guiding channel, and for providing a tactile indication during rotation of the closure on the container when the projection passes the first position;

whereby the closure can be (a) positioned on the container in an open position, from which open position the closure is removable from the container without rotation of the closure and (b) rotated about an axis in relation to the container, whereby the closure is movable repeatedly back and forth between the open position and a closed position, with provision of a tactile indication when the closure is moved between the open position and the closed position.

16. The assembly defined in claim 15, wherein the closure mounting means further comprises:

second hindering means, comprising mutually cooperating elements of the closure and the container that cooperate during rotation of the closure relative to the container, for hindering movement along the guiding channel of the projection past a predetermined second position along the guiding channel, for providing a tactile sensation during rotation of the closure on the container when the projection passes the second position, and for defining a projection retention region of the guiding channel between the first and second positions of the closure, wherein the projection is retained in the projection retention region between the first and second hindering means in a venting position of the closure, in which a venting passage is opened between the closure and the container;

whereby the closure can be (a) positioned on the container in an open position, which open position the closure is removable from the container without rotation of the closure, and (b) rotated about an axis in relation to the container, whereby the closure is movable repeatedly back and forth between the open position, the venting position in which the projection is retained by the first and second hindering means, and a closed position, with provision of a tactile indication when the closure is moved between the venting position, the open position, and the closed position.

17. The assembly defined in claim 15, wherein the guiding channel has a first axial inclination along a first stretch of the guiding channel in a closure closing direction of movement of the projection along said guiding channel, a second axial inclination along a subsequent second stretch of the guiding channel, and a third axial inclination along a subsequent third stretch of the guiding channel, the first axial inclination being larger than the second axial inclination, and the third axial inclination being substantially equal to zero.

18. The assembly defined in claim 16, wherein the first hindering means is located so that a tactile indication is given when the closure has reached its open position after rotation from its closed position.

19. The assembly defined in claim 16, wherein the first and second hindering means are located at a distance from each other along the guiding channel so that the projection may be retained in the projection retention region defined by the first and second hindering means.

20. The assembly defined in claim 15, wherein the closure mounting means further comprises stopping means for effectively stopping the closing movement of the projection at the end of the guiding channel in the closing direction.

21. The assembly defined in claim 15, wherein the closure mounting means further comprises projection positioning means for guiding the projection into a position adjacent the starting point of the guiding channel when the closure is moved in a closing direction from the open position.

22. The assembly defined in claim 21, wherein the projection positioning means comprises a funnel-shaped channel having walls tapering inwardly in an axial closing direction of the projection so as to lead the projection to a point adjacent the starting point of the guiding channel when the closure is moved in its axial closing direction from the open position.

23. The assembly defined in claim 22, wherein the projection positioning means includes at least two adjacent funnel-shaped channels separated by a wall surface, and wherein each funnel-shaped channel is formed between the wall surface separating the at least two adjacent funnel-shaped channels, said wall surface defining a sharp tip at the opening of the funnel-shaped channels.

24. The assembly defined in claim 16, wherein the closure has an outer surface and comprises indicating means positioned on the outer surface of the closure for visually indicating when the projection is located in the projection retention region of the guiding channel and when the closure is in the closed position.

25. The assembly defined in claim 15, wherein the closure mounting means comprises three projections and three corresponding guiding channels, with a circumferential angle between the projections of about 120° and a circumferential angle between corresponding starting points of the guiding channels also of about 120°.

26. The assembly defined in claim 25, wherein an angle is defined between a center of the venting position of the closure and its closed position of approximately 60°.

27. The assembly defined in claim 15, wherein the closure mounting means comprises four projections and four corresponding guiding channels, with a circumferential angle between the projections of about 90° and a circumferential angle between corresponding starting points of the guiding channels also of about 90°.

28. The assembly defined in claim 27, wherein an angle is defined between a center of the venting position of the closure and its closed position of approximately 45°.

29. A container and closure assembly comprising:

a container having an opening defined therein;

a closure configured to be positioned on the container for closing the opening; and closure mounting means comprising:

a projection provided on one of the container and the closure; and a circumferentially extending guiding channel defined by opposed walls that are configured to receive the projection between them, the channel being provided in the one of the closure and the container that does not have the projection, the guiding channel including first and second hindering means located at a distance from each other along the guiding channel so that the projection may be retained in a projection retention region thus defined by the first and second hindering means, the guiding channel having an axial component with at least two different axial inclinations along the guiding channel;

wherein the first and second hindering means comprise mutually cooperating elements of the closure and the container that cooperate during rotation of the closure relative to the container, for hindering movement along the guiding channel of the projection past predetermined first and second positions along the guiding channel, for providing a tactile indication during rotation of the closure on the container when the projection passes the first and second positions, respectively, and for defining the projection retention region of the guiding channel between the first and the second positions of the closure, wherein the projection is retained in the projection retention region between the first and second hindering means in a venting position of the closure in which a venting passage is open between the closure and the container;

whereby the closure can be (a) positioned on the container in an open position, from which open position the closure is removable from the container without rotation of the closure and (b) rotated about an axis in relation to the container, whereby the closure is movable repeatedly back and forth between the open position, the venting position in which the projection is retained by the first and second hindering means, and a closed position, with provision of a tactile indication when the closure is moved between its venting position, its open position, and its closed position.

30. A container and closure assembly, comprising:

a container having an opening defined therein;

a closure configured to be positioned on the container for closing the opening; and closure mounting means, comprising:

a projection provided on one of the container and the closure; and a circumferentially extending guiding channel defined by opposed walls that are configured to receive the projection between them, the channel being provided on the one of the closure and the container that does not have the projection, the guiding channel including first and second hindering means located at a distance from each other along the guiding channel so that the projection may be retained in a projection retention region thus defined by the first and second hindering means, the guiding channel having a first axial inclination along a first stretch of the guiding channel in the closure closing direction of movement of the projection along said guiding channel, a second axial inclination along a subsequent second stretch of the guiding channel, and a third axial inclination along a subsequent third stretch of the guiding channel, the first axial inclination being larger than the second axial inclination, and the third axial inclination being substantially equal to zero;

wherein the first and second hindering means comprise mutually cooperating elements of the closure and the container that cooperate during rotation of the closure relative to the container for hindering movement along the guiding channel of the projection past predetermined first and second positions along the guiding channel, for providing a tactile indication during rotation of the closure on the container when the projection passes the first and second positions, respectively, and for defining the projection retention region of the guiding channel between the first and the second positions of the closure, wherein the projection is retained in the projection retention region between the first and second hindering means in a venting position of the closure in which a venting passage is open between the closure and the container;

so that the closure can be (a) positioned on the container in an open position, from which open position the closure is removable from the container without rotation of the closure and (b) rotated about an axis in relation to the container, whereby the closure is movable repeatedly back and forth between the open position, the venting position in which the projection is retained by the first and second hindering means, and a closed position, with provision of a tactile indication when the closure is moved between its venting position, its open position, and its closed position.

* * * * *